US008683762B2

(12) United States Patent
Rodriquez et al.

(10) Patent No.: US 8,683,762 B2
(45) Date of Patent: Apr. 1, 2014

(54) DATA CENTER FLOORING ARRANGEMENTS

(71) Applicant: International Business Machines Corporation, Armonk, NY (US)

(72) Inventors: Jean-Michel Rodriquez, Montpellier (FR); Emmanuel Tong-Viet, Montpellier (FR)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 13/740,304

(22) Filed: Jan. 14, 2013

(65) Prior Publication Data

US 2013/0263539 A1 Oct. 10, 2013

(30) Foreign Application Priority Data

Apr. 4, 2012 (EP) ..... 12305401

(51) Int. Cl.
*E04C 2/52* (2006.01)

(52) U.S. Cl.
USPC ..... 52/220.8; 52/263; 52/745.13; 174/660; 454/184

(58) Field of Classification Search
USPC ..... 52/100, 220.8, 263, 745.13; 428/114; 454/184; 174/659, 660
See application file for complete search history.

(56) References Cited

U.S. PATENT DOCUMENTS

| | | | | |
|---|---|---|---|---|
| 3,938,295 | A * | 2/1976 | Tate | 52/747.1 |
| 4,085,557 | A * | 4/1978 | Tharp | 52/263 |
| 6,176,052 | B1 * | 1/2001 | Takahashi | 52/232 |
| 6,550,195 | B1 * | 4/2003 | Cooper et al. | 52/220.3 |
| 6,632,999 | B2 * | 10/2003 | Sempliner et al. | 174/659 |
| RE41,863 | E * | 10/2010 | Sempliner et al. | 174/650 |
| RE43,175 | E * | 2/2012 | Sempliner et al. | 174/650 |
| 8,266,854 | B2 * | 9/2012 | Reddicliffe | 52/220.8 |
| 8,397,451 | B2 * | 3/2013 | Pirner | 52/220.8 |
| 8,415,562 | B2 * | 4/2013 | Curtin et al. | 174/50 |
| 2003/0079897 | A1 | 5/2003 | Sempliner et al. | |
| 2009/0151983 | A1 | 6/2009 | Sempliner et al. | |
| 2009/0260874 | A1 | 10/2009 | Eckberg et al. | |
| 2010/0064610 | A1 | 3/2010 | Kulkarni et al. | |
| 2010/0248609 | A1 | 9/2010 | Tresh et al. | |
| 2011/0173906 | A1 * | 7/2011 | Reddicliffe | 52/220.8 |
| 2011/0223849 | A1 * | 9/2011 | Ishimine et al. | 454/184 |
| 2012/0279779 | A1 * | 11/2012 | Cottuli et al. | 174/660 |
| 2013/0260666 | A1 * | 10/2013 | Rodriquez et al. | 454/184 |

FOREIGN PATENT DOCUMENTS

| | | | | |
|---|---|---|---|---|
| EP | 202518 | A2 * | 11/1986 | E04D 9/00 |
| EP | 340321 | A1 * | 11/1989 | E04D 9/00 |
| EP | 2189875 | A2 | 5/2010 | |

OTHER PUBLICATIONS

Hoffman Enclosures Inc., "Data Center Floor Brush Kits, Networking: Thermal Management," www.hoffmanonline.com, 2009, 4 pages.
Pentair Technical Products, "Overview & Design of Data Center Cabinets", pentairtechnicalproducts.com, 2010, 28 pages.

* cited by examiner

*Primary Examiner* — Robert Canfield
(74) *Attorney, Agent, or Firm* — Jean S. Sullivan; Hoffman Warnick LLC

(57) ABSTRACT

A barrier element for forming a component of a floor covering of a floor in a data center includes a substantially laminar part, the laminar part having a cross member attached to one surface. The cross member mounts a plurality of filaments which can form a layer impervious to air flow.

13 Claims, 6 Drawing Sheets

DATA CENTER FLOORING ARRANGEMENTS

TECHNICAL FIELD

The present invention relates to the field of data center flooring.

More particularly, the present invention relates to improvements in air flow in relation to data center flooring.

RELATED ART

The growth of computer networking, and particularly the rapid growth of the use of the Internet, has resulted in a rapid increase in demand for server computers. Most commonly a number of modular server units, for example the modular computing units known as "blade" servers, are removably mounted in equipment racks. Typically, a large number of such racks are housed in a building known as a data center. In a data center, one or more large rooms are provided. Each room houses rows of equipment racks and their mounted servers, and associated cabling and network communication equipment.

A modern rack when fully loaded with blade servers consumes a large amount of electrical power when operating. In consequence, a large amount of waste heat is produced. Many data centers now employ individual racks of blade servers in which each rack develops 20 kW or more of waste heat. To avoid damage to the servers by overheating, this waste heat must be removed.

In a commonly used arrangement, data center rooms are cooled by computer room air conditioning units (termed CRACs) which circulate cooled air which passes through the rack units for heat removal. Typically, a data center room comprises a raised floor above a plenum chamber through which cooled air is blown by CRAC units. Rows of server racks are mounted on the floor separated by aisles. Networks of grilles in the floors of the aisles between rows of server racks allow cooled air from the plenum to rise into the aisles. From here it is typically drawn through the front of the racks by fans mounted in the racks. Heated air passes out of the other side of the rack and is drawn up into a roof plenum chamber for removal or recirculation through the CRAC units. In a commonly used arrangement, an aisle comprises two rows of server racks whose fronts face each other with the floor of the aisle space between comprising a number of grilles through which cooled air rises. This is termed a cold aisle. Behind each row of racks is a hot aisle to which heated air passes after flowing through the racks and then rises for removal by way of the roof plenum chamber.

In such an arrangement, it is important that the raised floor be impervious to air flow except at the grilles which allow cool air to flow from the sub-floor plenum into the cold aisles. The large number of server computer units in the typical data center described above requires a large amount of electrical power supply cabling and network cabling, and sometimes other service conduits to provide additional water cooling, for example. Much of this service provision, such as cabling, is routed below the raised floor of the data center through the sub-floor plenum chamber. This necessitates the piercing of the raised floor. To maintain as far as possible the impervious nature of the raised floor to air flow, some form of sealing is required around the cabling or other conduit at the point where it passes through the raised floor to prevent air leakage here. The conventional solution to this problem is to provide a grommet closure device through which the cabling or other conduit passes. A hole of the required size is cut in one of the floor tiles which make up the raised floor covering, a grommet inserted, and cabling or conduit passed through the grommet.

Typically, the grommet opening is rectangular and sealed by multiple flexible elements akin to brush bristles protruding from two opposite sides of the opening to meet along the center line of the opening. Cabling is passed through the bristles which are deflected by the cabling and spring back to substantially fill the remaining space and so minimize air passage through the bristles.

United States published patent application no. US 2003/0079897 comprises a floor grommet for use in building and office structures supplied with air conditioning via under floor plenum. Directed flow of conditioned air is optimized by limiting the escape of air from the plenum into the space above the floor by leakage through floor openings provided for power cables, data cables and the like. Specialized floor grommets installed in the cable openings are comprised of a surrounding frame mounting sealing elements comprised of thin, flexible elements which are anchored at one end in the grommet frame and extend toward the center of the opening, from each side, to effectively close the opening against significant flow of conditioned air from the plenum below. Cables passing through the grommet opening cause minimal deflection of the flexible elements to limit the escape of conditioned air. Preferably, the resilient, flexible elements are filamentary in nature. The grommet arrangements of the prior art impose restrictions on the user as the grommets are generally available only in a limited range of sizes and shapes. It is sometimes necessary when rearranging the rack positions and cabling or other service conduits in a data center to provide new holes in the raised floor. It would be desirable to provide a solution to the lack of flexibility in available hole sealing arrangements.

SUMMARY OF THE INVENTION

Viewed from a first aspect, the invention provides a barrier element suitable for forming a component of a floor covering of a floor in a data center. The barrier element comprises a substantially laminar part, the laminar part comprising a surface, the surface further comprising a cross member. The cross member further comprises a plurality of filaments mounted on the cross member.

In an embodiment, the present invention provides a barrier element in which the cross member has a length dimension substantially larger than either a width dimension or a depth dimension, the cross member being attached to the surface of the barrier element so that the length dimension occupies substantially the whole of a distance between a first edge of the surface of the barrier element and a second edge opposite the first edge. The width dimension is approximately equidistant between a third edge of the surface of the element and a fourth edge opposite the third edge.

In an embodiment, the present invention provides a barrier element which is a floor covering element.

In an embodiment, the present invention provides a barrier element which is a floor tile.

In an embodiment, the present invention provides a barrier element in which one of the plurality of filaments is mounted firmly but not fixedly by holding in the cross member so that the filament may be pushed through the cross member.

In an embodiment, the present invention provides a barrier element in which the holding comprises a push fit in a hole through the full width of the cross member.

In an embodiment, the present invention provides a barrier element in which the hole is through an elastomeric material in the cross member.

In an embodiment, the present invention provides a barrier element in which one of the filaments is a flexible filament.

In an embodiment, the present invention provides a barrier element in which one of the filaments has a length approximately the same as the distance between the cross member and the third edge.

In an embodiment, the present invention provides a barrier element in which the plurality of filaments form a layer substantially impervious to air flow.

In an embodiment, the present invention provides a barrier element in which a portion of the laminar part may be removed.

In an embodiment, the present invention provides a barrier element in which the removed portion of the laminar part comprises a cut-out or cut-away portion.

In an embodiment, the present invention provides a barrier element in which an item is positioned to pass through the barrier element by way of the removed portion.

In an embodiment, the present invention provides a barrier element in which the item comprises a service conduit.

In an embodiment, the present invention provides a barrier element in which the service conduit comprises an electrical cable.

In an embodiment, the present invention provides a barrier element in which a plurality of filaments is pushed through the cross member to at least abut the item passing through the removed portion so as to render the removed portion substantially impervious to air flow.

Viewed from a second aspect, the invention provides a method for covering a framework suitable for forming a floor in a data center. The method comprises providing a barrier element for covering the framework, the barrier element comprising a substantially laminar part, the laminar part comprising a surface, and providing a cross member on the surface. The method further provides the cross member with a plurality of filaments mounted on the cross member.

In an embodiment, the present invention provides a method in which the cross member has a length dimension substantially larger than either a width dimension or a depth dimension. The method further involves attaching the cross member to the surface of the barrier element so that the length dimension occupies substantially the whole of a distance between a first edge of the surface of the barrier element and a second edge opposite the first edge, and in which the width dimension is approximately equidistant between a third edge of the surface of the element and a fourth edge opposite the third edge, In an embodiment, the present invention provides a method in which the barrier element comprises a floor covering element.

In an embodiment, the present invention provides a method in which the floor covering element comprises a floor tile.

In an embodiment, the present invention provides a method further comprising mounting one of the plurality of filaments firmly but not fixedly by holding in the cross member so that the filament may be pushed through the cross member.

In an embodiment, the present invention provides a method in which the holding comprises push fitting in a hole through the full width of the cross member.

In an embodiment, the present invention provides a method in which the hole is through an elastomeric material in the cross member.

In an embodiment, the present invention provides a method in which one of the filaments is a flexible filament.

In an embodiment, the present invention provides a method in which one of the filaments has a length approximately the same as the distance between the cross member and the third edge.

In an embodiment, the present invention provides a method in which the plurality of filaments form a layer substantially impervious to air flow.

In an embodiment, the present invention provides a method further comprising removing a portion of the laminar part.

In an embodiment, the present invention provides a method in which the step of removing further comprises cutting through the laminar part to form a cut-out or cut-away portion.

In an embodiment, the present invention provides a method further comprising positioning an item to pass through the barrier element by way of the removed portion.

In an embodiment, the present invention provides a method in which the item comprises a service conduit.

In an embodiment, the present invention provides a method in which the service conduit comprises an electrical cable.

In an embodiment, the present invention provides a method further comprising pushing a plurality of filaments through the cross member to at least abut the item passing through the removed portion so as to render the removed portion substantially impervious to air flow.

BRIEF DESCRIPTION OF THE DRAWINGS

Embodiments of the invention will now be described in detail by way of example only with reference to the following drawings.

DETAILED DESCRIPTION OF THE INVENTION

Figure 1:
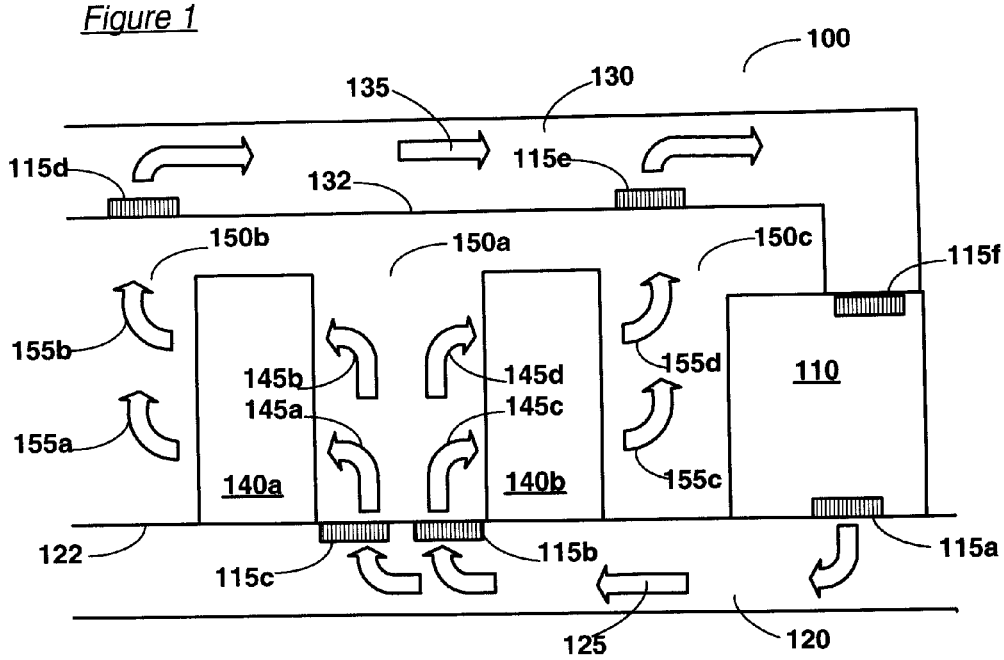
FIG. 1 is a cross-section of a prior art data center in which embodiments of the invention may be employed.

FIG. 1 illustrates a cross-section of a data center room 100 suitable for incorporating embodiments of the present invention. A conditioning unit, for example, a computer room air conditioning unit (CRAC) 110 comprises chiller and blower components for, respectively, chilling and impelling fluid for circulating in the data center room. The circulating fluid functions for removal of heat generated by equipment operating in data center room 100. In embodiments, the circulating fluid is a gaseous fluid, and the fluid is the ambient air of data center room 100. In embodiments, CRAC 110 blows chilled air through grille 115*a* into a sub-floor plenum chamber 120. The sub-floor plenum chamber 120 extends over substantially the whole floor area of data center room 100. The floor 122 is suitably supported above the sub-floor plenum chamber 120 to carry rows of equipment racks such as 140*a* and 140*b* as illustrated. The equipment racks 140*a*, 140*b* each comprise a rack framework suitable for mounting modular data processing units, for example server computing units such as blade servers.

Air flows through the sub-floor plenum chamber 120 as shown by arrow 125. Air flows from the sub-floor plenum chamber 120 up through grilles 115*b*, 115*c* into a cold aisle 150*a*. From here air is drawn through the front of the racks 140*a*, 140*b* by air movers, such as fans, mounted within the racks 140*a*, 140*b*. Air flow 145*a*, 145*b* is shown entering the front of the rack 140*a* and air flow 145*c*, 145*d* entering the front of the rack 140*b*. Air exits 155*a*, 155*b* from the rear of the rack 140*a* into a hot aisle 150*b*. Similarly, air exits 155*c*, 155*d* from the rear of the rack 140*b* into a hot aisle 150*c*. Air is then drawn upwards from the hot aisle 150*b* through a grille 115*d* in the roof 132 into roof a plenum chamber 130. Similarly, air is drawn upwards from the hot aisle 150*c* through a grille 115*e* in the roof 132 into the roof plenum chamber 130. The roof plenum chamber 130 extends over substantially the whole roof area of data center room 100. Air flows 135 through the roof plenum chamber 130 and re-enters the CRAC 110 by way of a grille 115*f*.

Figure 2:
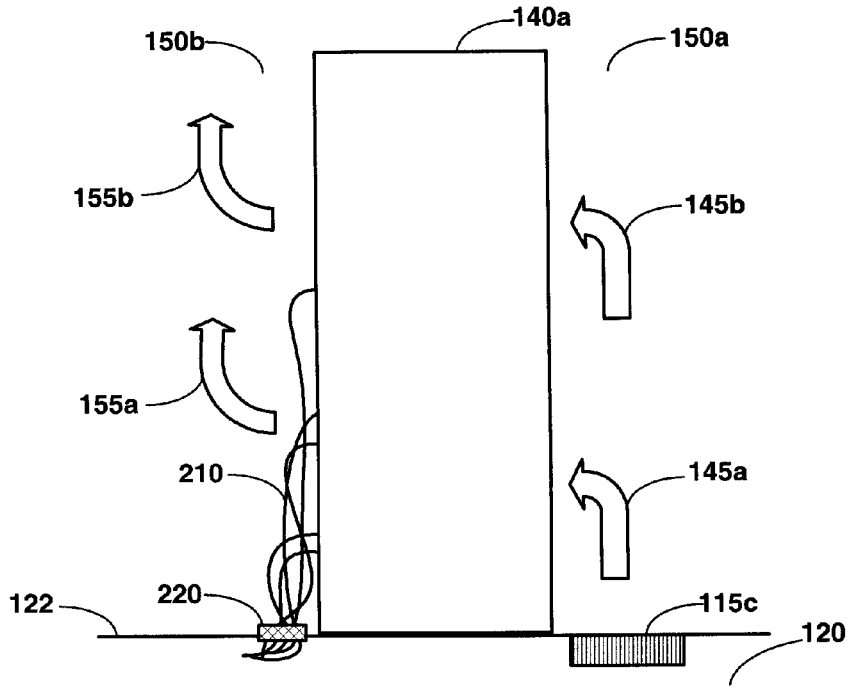
FIG. 2 is a cross-section of an equipment rack and aisles as illustrated in the data center of FIG. 1 in which embodiments of the invention may be employed.

FIG. 2 illustrates the rack 140*a* as shown in FIG. 1. In the cold aisle 150*a*, air flow 145*a*, 145*b* is shown rising from the grille 115*c* in the raised floor 122 and entering the front of the rack 140*a*. In the hot aisle 150*b*, air flow 155*a*, 155*b* is shown exiting the rear of the rack 140*a*. Power and/or networking cabling 210 is shown passing from the rear of the rack 140*a*, through a grommet 220 as known in the prior art, and into the plenum chamber 120 below the raised floor 122. Typically, the raised floor 122 comprises a framework of metal or other structural material on to which are laid floor covering elements. The floor covering elements may themselves be structural or, where allowed by the raised floor framework, they may comprise barrier elements such as floor tiles which serve to maintain the impervious nature of the raised floor. In areas where passage of cabling is allowed by the skeletal nature of the supporting framework of the raised floor 122, covering floor tiles may be cut to allow the insertion of a grommet 220.

It will be apparent that although the invention is described with reference to embodiments in a floor structure of a data center, other embodiments may apply to other environments in which it is desirable to keep the fluid contents of two volumes from admixing. In some embodiments the framework may comprise a wall structure for example, and the barrier elements will then form components of a wall covering.

Figure 3A:
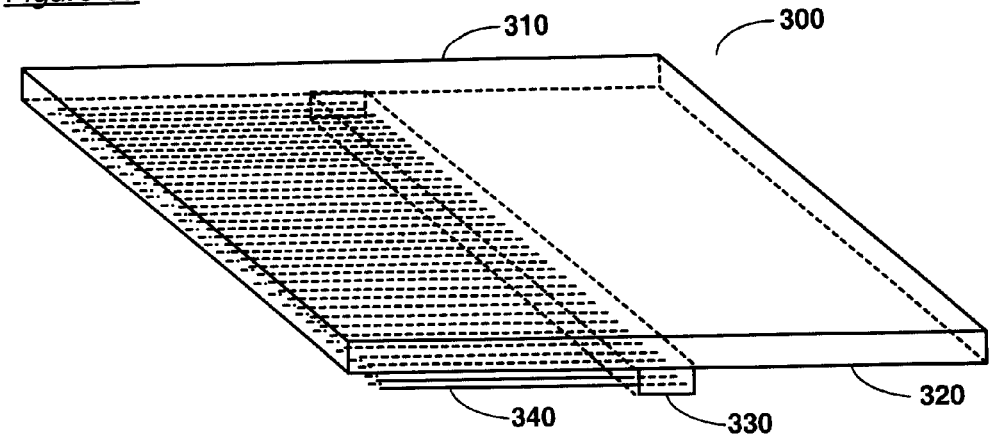
FIG. 3*a* is a perspective view of a tile according to embodiments of the invention.
Figure 3B:
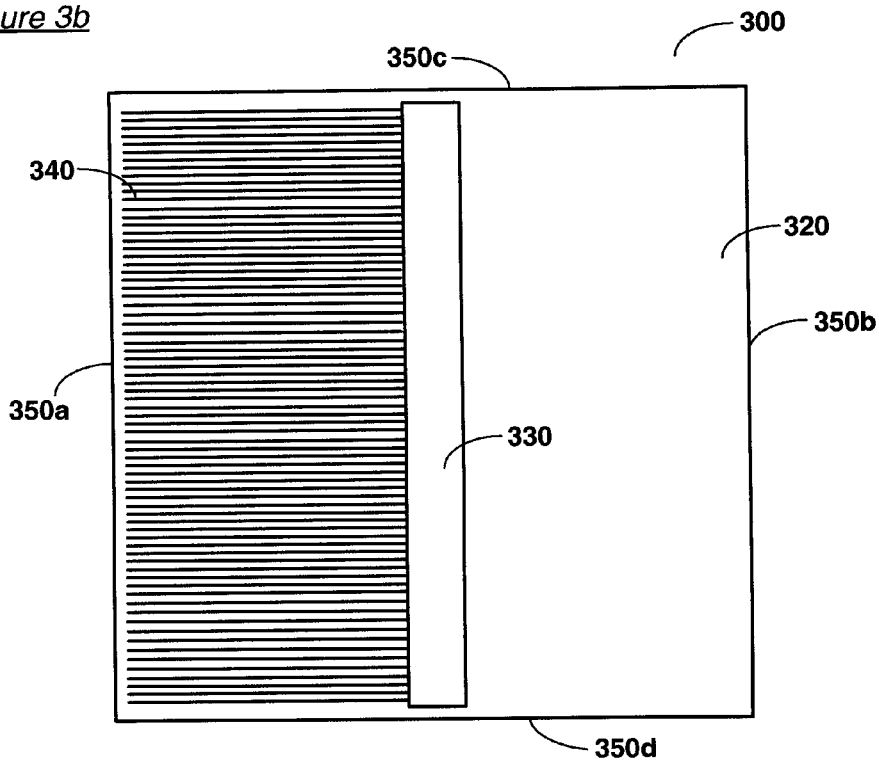
FIG. 3*b* is a plan view of the underside of a tile according to embodiments of the invention.

FIG. 3*a* illustrates a perspective view of a barrier element according to embodiments of the present invention in which the barrier element is a component of a floor covering for a raised floor 122 in a data center 100. As shown, the barrier element comprises a floor tile 300. The floor tile 300 has a top surface 310 and a bottom surface 320. A cross member 330 is attached to the bottom surface 320 of the tile 300. FIG. 3*b* illustrates a plan view of the bottom surface 320 of the tile 300. The cross member 330 is attached approximately equidistant from opposite edges 350*a* and 350*b* and extends over substantially the whole of the width of the bottom surface 320 between opposite edges 350*c* and 350*d*. In embodiments, the cross member 330 does not extend over the full width of the bottom surface 320 but terminates a short distance from each of the edges 350*c* and 350*d*, relative to the full width of the bottom surface 320. The floor tile 300 may be used in like manner to a conventional floor tile of the prior art laid over structural framework of the raised floor 122 of FIG. 2.

Figure 3C:
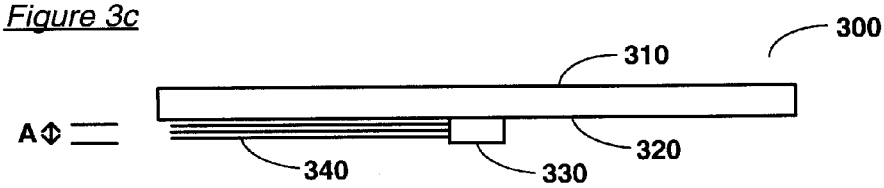
FIG. 3*c* is an edge on view of a tile according to embodiments of the invention.

In embodiments, the cross member 330 also comprises a plurality of thin elements, for example, flexible elements or filaments 340 akin to brush bristles as shown in FIG. 3*a* and FIG. 3*b*. As shown in FIG. 3*b*, the flexible filaments 340 may occupy most of the width of the tile 300 between the tile edges 350*c* and 350*d*, and extend for most of the distance between the cross member 330 and the tile edge 350*a*. FIG. 3*c* shows an edge on view of the tile 300, with the top surface 310, the bottom surface 320, the cross member 330 and the flexible filaments 340 forming a layer of thickness A. Although shown for clarity in FIGS. 3*a*, 3*b* and 3*c* as individual filaments spaced apart from each other, the flexible filaments 340 are so arranged and spaced as to form a layer of thickness A in FIG. 3*c* so that the layer is essentially impervious to air flow.

Figure 4A:
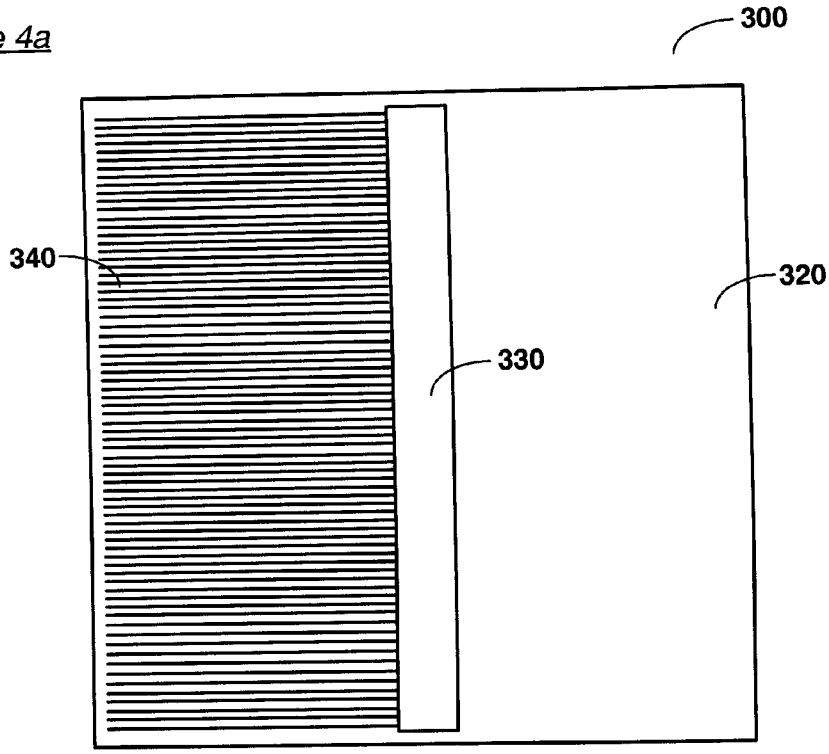
FIGS. 4*a* and 4*b* are plan views of the underside of a tile illustrating aspects of the operation of embodiments of the invention.
Figure 4B:
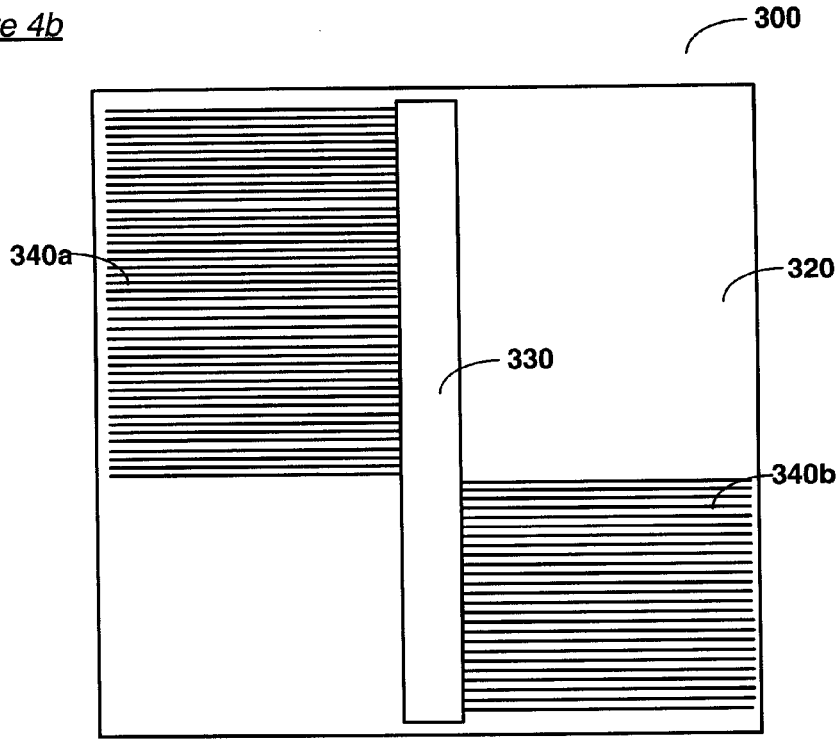

As depicted in FIG. 4*a*, in embodiments, the underside 320 of the tile 300 comprises a cross member 330 and flexible filaments 340. The flexible filaments 340 are mounted at a proximal end in the cross member 330, allowing the distal end of each flexible filament 340 to move from side to side and up and down. The proximal end of each flexible filament 340 is mounted firmly but not fixedly by inserting in the cross member 330 in such a way as to allow each flexible filament to be pushed through the cross member 330 but not allow filament lateral movement within the cross member 330. In embodiments, the mounting is a push fit in a cylindrical hole through the cross member 330. In embodiments, the cylindrical hole is through an elastomeric material in the cross member 330. As illustrated in FIG. 4*b*, flexible filaments 340*b* have been pushed through cross member 330 whilst flexible filaments 340*a* have not.

Figure 5A:
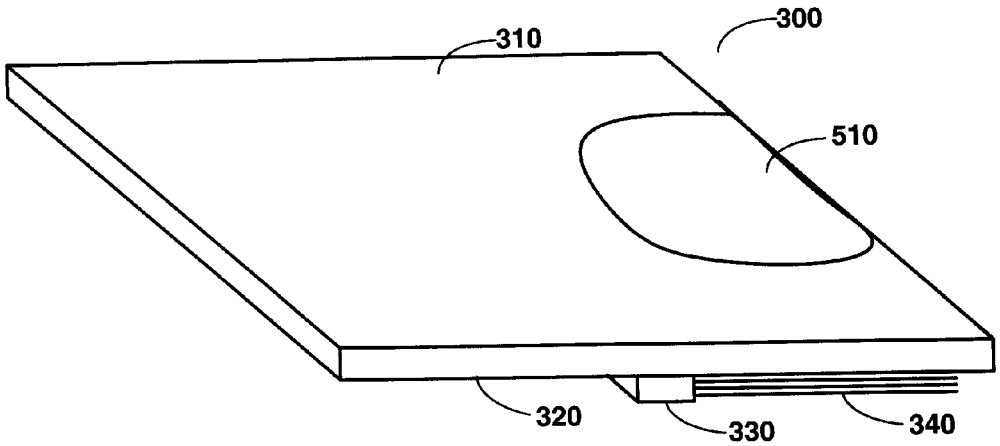
FIGS. 5*a* and 5*b* are perspective views illustrating aspects of the operation of embodiments of the present invention.
Figure 5B:
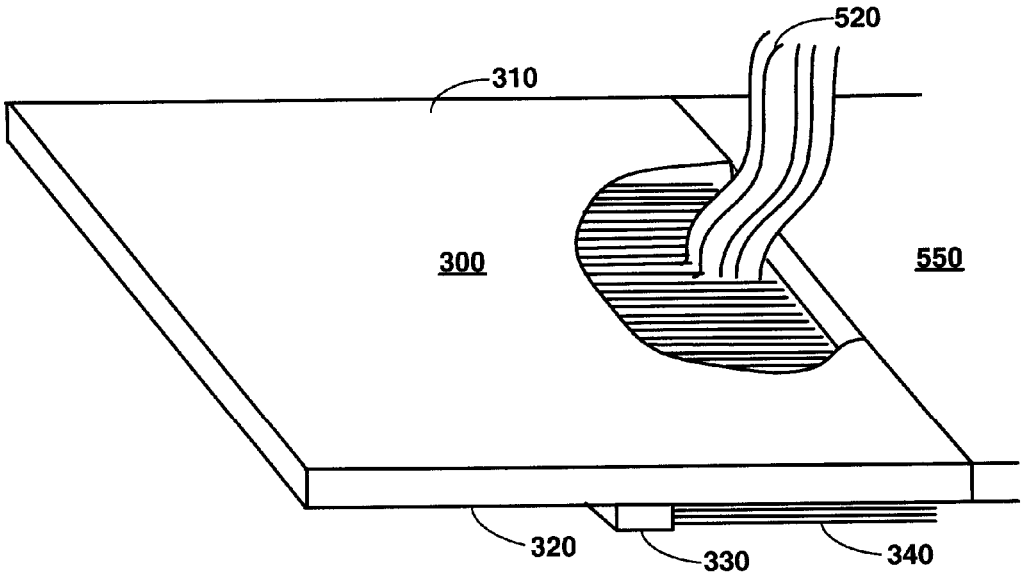

As depicted in FIG. 5*a*, in embodiments, the tile 300 comprises a top surface 310 and a bottom surface 320. The cross member 330 comprises flexible filaments 340 as previously described. Also illustrated is section 510 of the tile 300. The section 510 may be of any convenient size or shape and is cut away using a knife or similar implement and removed. FIG. 5*b* shows the tile 300 of FIG. 5*a* in operation. The tile portion 510 has been removed and power and/or network cabling 520 has been passed through the resulting hole. The flexible filaments 340 have been pushed through the cross member 330 to abut the cabling 520. It will be apparent to those skilled in the art that the filaments 340 may be pushed further so as to be bent out of shape by pressure of the cabling 520 so as to potentially enhance the sealing effect. Also shown is an adjacent tile 550, but it will be apparent that the tile 300 may be used in other arrangements, for example against a wall or the rear surface of an equipment rack.

Figure 6A:
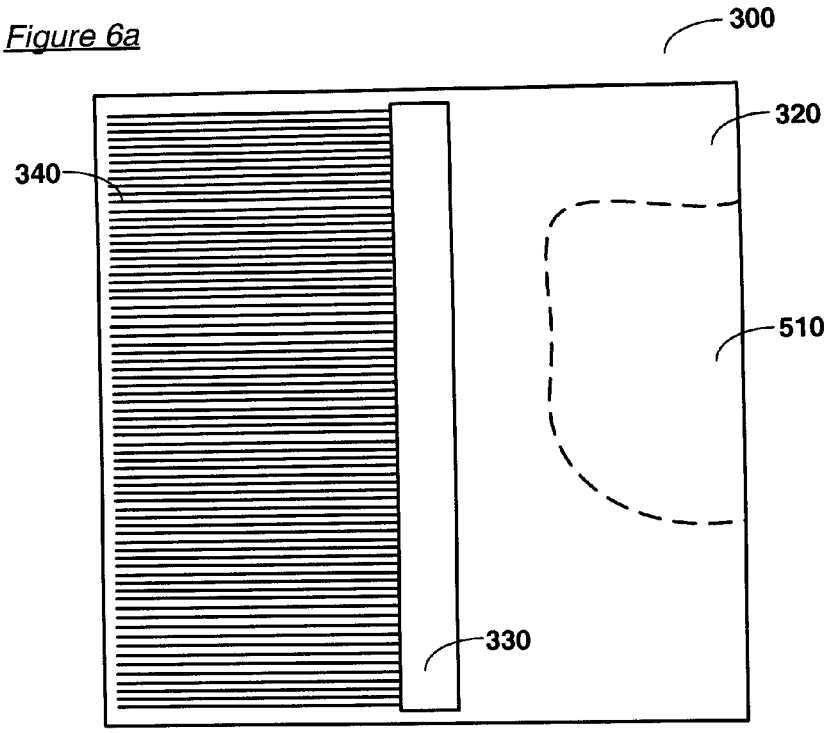
FIGS. 6*a* and 6*b* are plan views of the underside of a tile illustrating the operation of embodiments of the invention.
Figure 6B:
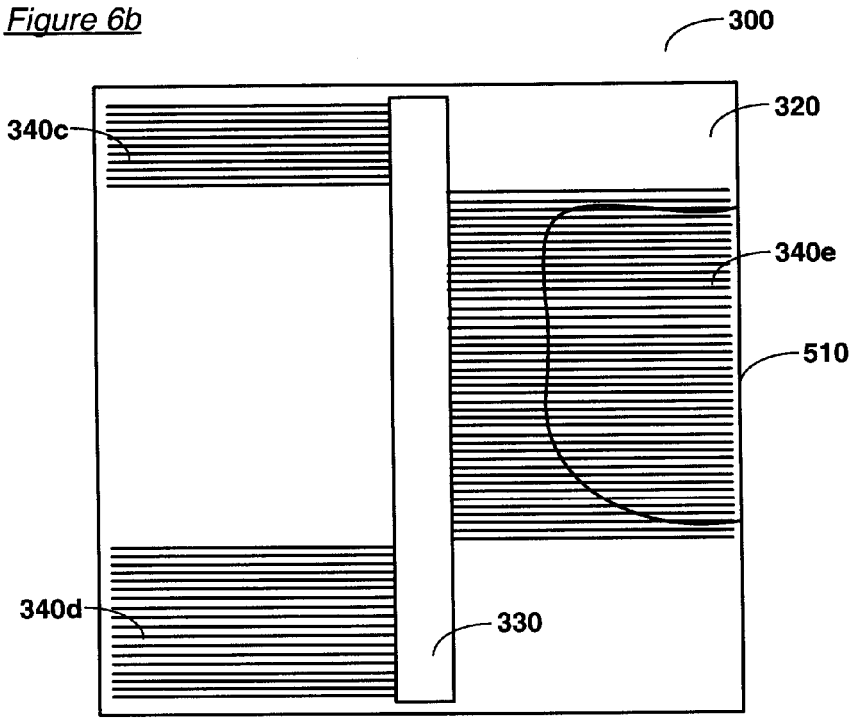

FIG. 6*a* illustrates a plan view of the underside 320 of the tile 300 of FIG. 5*a* according to embodiments of the present invention. The flexible filaments 340 are illustrated all on one side of the cross member 330. Also illustrated is the section 510 delimited by a dotted line and which is removed using a knife or similar implement. FIG. 6*b* illustrates the underside 320 of the tile 300 after removal of the section 510. A portion 340*e* of the flexible filaments 340 have been pushed through the cross member 330 to cover the missing section 510 and render this section effectively impervious to air flow when the tile 300 is placed on a suitable floor support framework. The portions 340*c* and 340*d* of the flexible filaments 340 remain in their starting position.

Figure 6C:
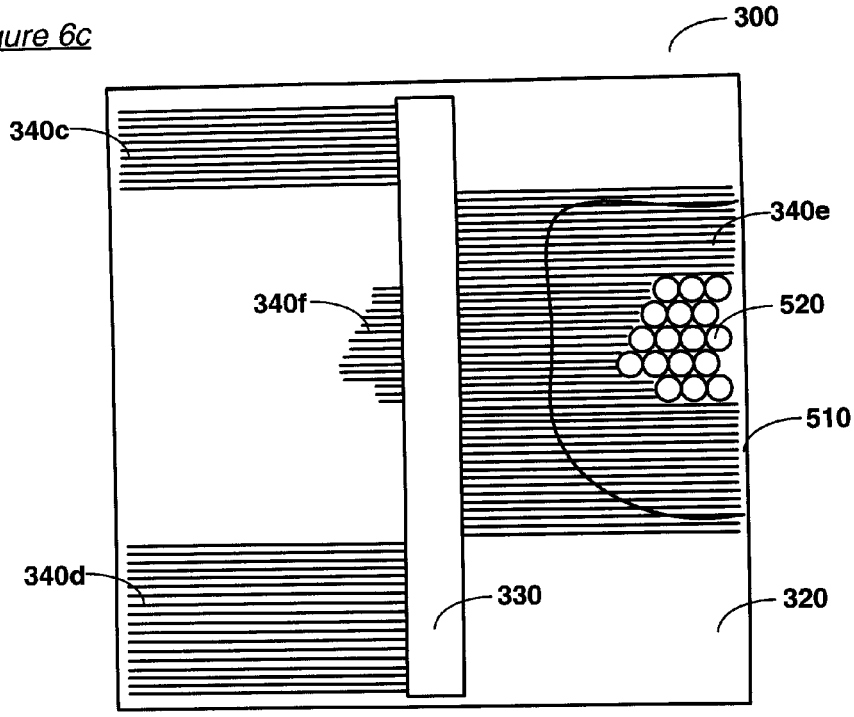
FIG. 6*c* is a plan view of the underside of a tile illustrating the operation of embodiments of the present invention.

FIG. 6*c* illustrates a plan view of the underside of tile 300 in operation according to embodiments of the present invention. A cross section of the cabling 520 is illustrated passing through the cut away section 510 of tile 300. The flexible filaments in the regions 340*c* and 340*d* remain as before. In the region 340*e*, some of the flexible filaments 340*f* have been pushed through the cross member 330 only so far as to abut the cabling 520. The remaining flexible filaments in the region 340*e* are pushed fully through the cross member 330 as in FIG. 6*b*. In operation, this configuration ensures that parts of the cut away section 510 not occupied by the cabling 520 are occupied by the flexible filaments 340 and so rendering the section 510 effectively impervious to air flow.

Figure 6D:
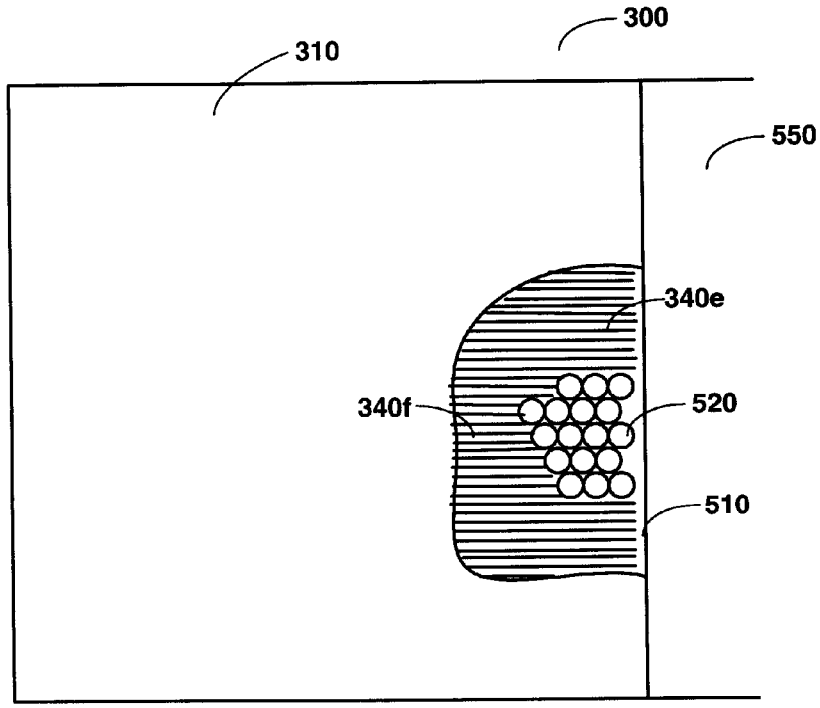
FIG. 6*d* is a plan view from above of the tile illustrated in FIG. 6*c*.

FIG. 6*d* illustrates a plan view of the top side 310 of the tile 300 depicted in FIG. 6*c*. The cross section of the cabling 520 is illustrated passing through the cut away section 510 in the tile 300. As in FIG. 6*c*, in the region 340*e*, some of the flexible filaments 340*f* have been pushed through the cross member 330 only so far as to abut the cabling 520. As in FIG. 6*c*, the remaining flexible filaments in the region 340*e* are pushed fully through the cross member 330, so that the cut away section 510 is rendered effectively impervious to air flow. An adjacent tile 550 is illustrated, but as before it will be apparent that the tile 300 may be used in other arrangements, for example against a wall or the rear surface of an equipment rack.

It will be appreciated that although embodiments of the invention have been described in relation to use as floor coverings in a raised floor data center, other arrangements are possible without departing from the invention and will be apparent to those of ordinary skill in the art.

The invention claimed is:

1. A barrier element for forming a component of a floor covering of a floor in a data center, the barrier element comprising:

a substantially laminar part, the laminar part having a surface and a removed portion, the surface comprising a cross member; and the cross member further comprising a plurality of filaments movably mounted on the cross member;

wherein each of the plurality of filaments is movably mounted via a push fit through a full width of the cross member to allow a length of the filament extending from opposing sides of the cross member to be adjusted, and wherein a plurality of the filaments are pushed through the cross member to at least abut an item passing through the removed portion of the surface so as to render the removed portion of the surface substantially impervious to air flow.

2. The barrier element as claimed in claim 1, wherein the cross member has a length dimension substantially larger than either a width dimension of the cross member or a depth dimension of the cross member, wherein the cross member is attached to the surface of the barrier element so that the length dimension occupies substantially a whole of a distance between a first edge of the surface of the barrier element and a second edge of the surface of the barrier element opposite the first edge, and wherein the width dimension is approximately equidistant between a third edge of the surface of the barrier element and a fourth edge of the surface of the barrier element opposite the third edge.

3. The barrier element as claimed in claim 2, wherein at least one of the plurality of filaments has a length approximately the same as a distance between the cross member and the third edge.

4. The barrier element as claimed in claim 1, wherein the barrier element comprises a floor covering element.

5. The barrier element as claimed in claim 1, wherein the filaments comprise a flexible filament.

6. The barrier element as claimed in claim 1, wherein the plurality of filaments form a layer substantially impervious to air flow.

7. A data center, comprising:

a floor comprising a plurality of tiles;

a plurality of data processing units mounted in equipment racks and supported by the floor;

wherein at least one of the tiles comprises:

a substantially laminar part, the laminar part having a surface and a removed portion, the surface comprising a cross member; and the cross member further comprising a plurality of filaments movably mounted on the cross member;

wherein each of the plurality of filaments is movably mounted via a push fit through a full width of the cross member to allow a length of the filament extending from opposing sides of the cross member to be adjusted, and wherein a plurality of the filaments are pushed through the cross member to at least abut an item passing through the removed portion of the surface so as to render the removed portion of the surface substantially impervious to air flow.

8. A method for covering a framework suitable for forming a floor in a data center, the method comprising:

covering the framework with a barrier element, the barrier element comprising:

a substantially laminar part, the laminar part having a surface and a removed portion; and a cross member on the surface;

movably mounting a plurality of filaments on the cross member via a push fit through a full width of the cross member to allow a length of each filament extending from opposing sides of the cross member to be adjusted; and pushing at least a portion of the plurality of the filaments through the cross member to at least abut an item passing through the removed portion so as to render the removed portion substantially impervious to air flow.

9. The method as claimed in claim 8, wherein the cross member has a length dimension substantially larger than either a width dimension of the cross member or a depth dimension of the cross member, the method further comprising attaching the cross member to the surface of the barrier element so that the length dimension occupies substantially a whole of a distance between a first edge of the surface of the barrier element and a second edge of the surface of the barrier element opposite the first edge, and wherein the width dimension is approximately equidistant between a third edge of the surface of the barrier element and a fourth edge of the surface of the barrier element opposite the third edge.

10. The method as claimed in claim 9, wherein at least one of the plurality of filaments has a length approximately the same as a distance between the cross member and the third edge.

11. The method as claimed in claim 8, wherein the barrier element comprises a floor covering element.

12. The method as claimed in claim 8, wherein at least one of the filaments is a flexible filament.

13. The method as claimed in claim 8, wherein the plurality of filaments form a layer substantially impervious to air flow.

* * * * *